United States Patent [19]

Curry

[11] 4,002,258

[45] Jan. 11, 1977

[54] CHILD RESISTANT CLOSURE

[75] Inventor: John J. Curry, Westchester, Ill.

[73] Assignee: Plastisonics Company, Inc., Chicago, Ill.

[22] Filed: Feb. 20, 1976

[21] Appl. No.: 659,912

[52] U.S. Cl. ..... 215/206; 215/219

[51] Int. Cl.[2] ..... B65D 55/02; B65D 85/56; H61J 1/00

[58] Field of Search ..... 215/219, 220, 206

[56] References Cited

UNITED STATES PATENTS

| | | | |
|---|---|---|---|
| 3,915,326 | 10/1975 | Hrubesky | 215/219 |
| 3,934,744 | 1/1976 | Curry | 215/219 |

*Primary Examiner*—George T. Hall
*Attorney, Agent, or Firm*—Diller, Brown, Ramik & Wight

[57] ABSTRACT

This disclosure relates to a child resistant closure for a container of the type including a neck finish adapted to have rotationally removed therefrom a closure. The closure includes a closure member which is applied to a container neck in a conventional manner and an overcap which is telescoped over the closure member and is normally freely rotatable relative thereto whereby removal of the closure member is normally prevented. The overcap is, however, radially shiftable relative to the closure member and there are interlockable means carried by the overcap and the closure member which are engaged upon such radial shifting so as to interlock the overcap with the closure member and permit the transfer of a rotational force applied to the overcap to be directed to the closure member to effect the removal thereof.

8 Claims, 7 Drawing Figures

FIG.1
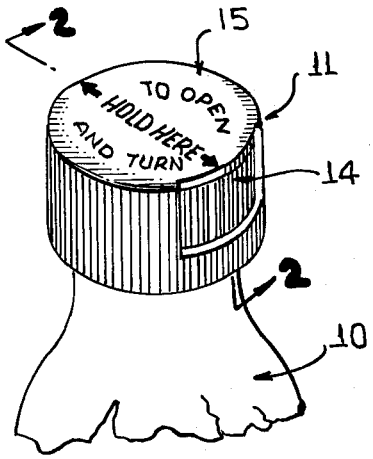
FIG.4
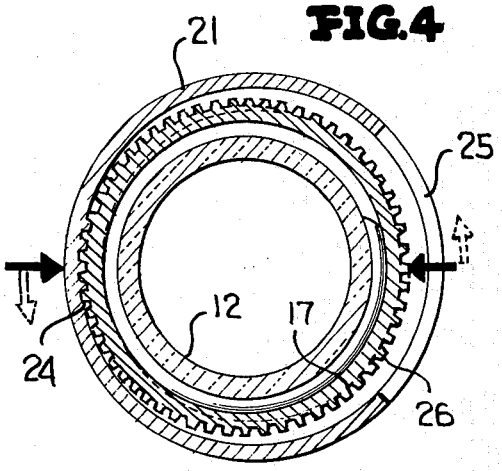
FIG.2
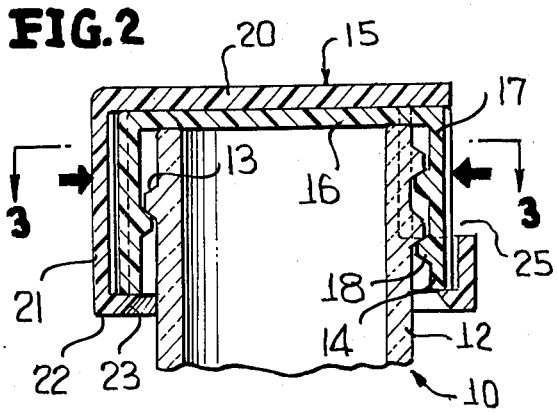
FIG.5
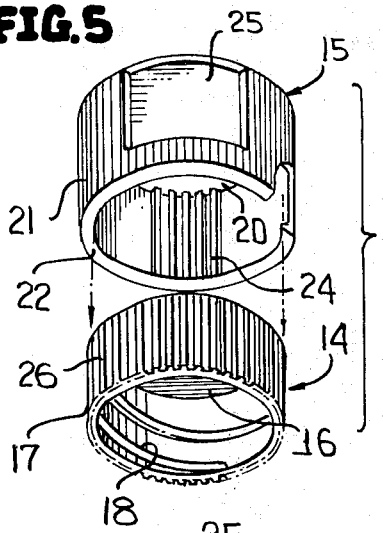
FIG.3
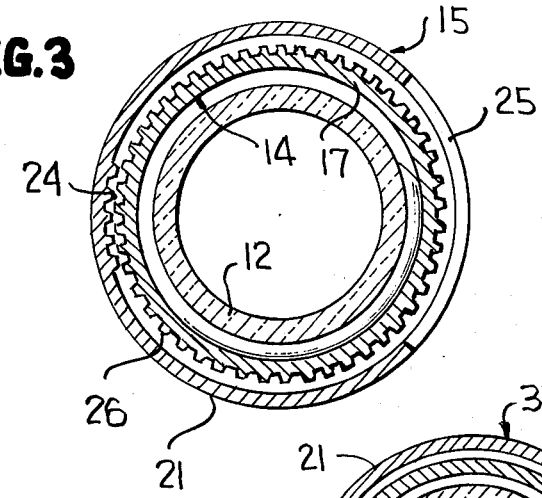
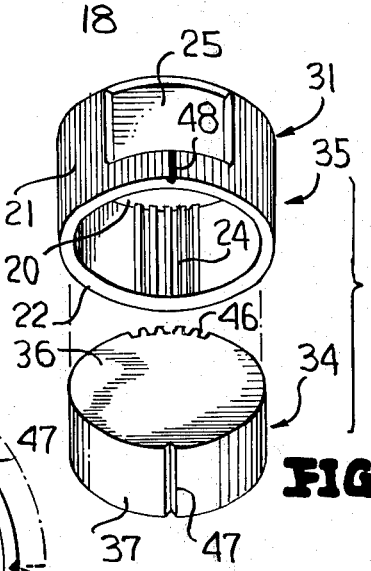
FIG.6
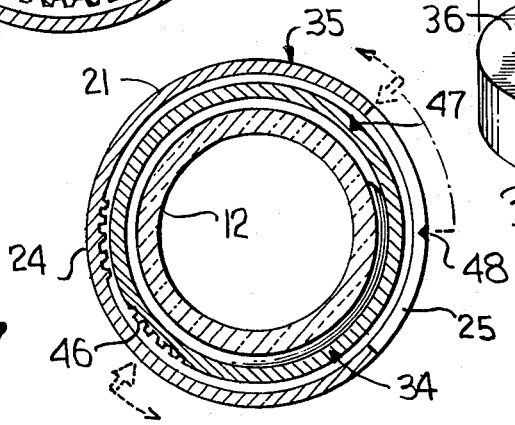
FIG.7

CHILD RESISTANT CLOSURE

This invention relates in general to new and useful improvements in container closures, and more specifically to a child resistant closure assembly.

BACKGROUND OF THE INVENTION

At the present time there are available numerous types of closure assemblies which must be actuated or positioned in a prescribed manner in order to facilitate the removal of the closure assembly from a container. Some of these assemblies require the pushing down on the closure assembly. Others require that the closure assembly be lifted up. Still other closure assemblies require the squeezing and deformation of an overcap with the overcap requiring a resilient wall construction so as to effect recovery. In addition, there are other assemblies which include complicated spring systems which keep the closure assembly components normally disengaged.

All of the available child resistant closure assemblies have deficiencies. Some when placed in their proper positions are still too difficult to actuate by adults, particularly older adults. Others are too complex or too expensive. Finally, others require complicated instructions difficult to follow.

SUMMARY OF THE INVENTION

In accordance with this invention there is provided a simple child resistant closure assembly which is of a two piece construction and wherein the two pieces thereof may be readily assembled. The closure assembly includes a conventional closure member which may be screw threaded or otherwise rotationally secured to a container neck finish. Telescoped over the closure member is an overcap. The closure member includes a skirt and the overcap includes a sleeve which are so dimensioned wherein normally there is a clearance between the sleeve and the skirt wherein the overcap is freely rotatable with respect to the closure member.

The sleeve and the skirt are provided with interlockable means which are engaged by radially shifting the sleeve relative to the skirt. This is facilitated by providing in the sleeve a window through which the skirt may be gripped at the same time the sleeve is gripped so that in the gripping of the closure assembly, the sleeve is automatically shifted relative to the skirt to effect the engagement of the interlockable means wherein the gripped closure assembly components may then be rotated in unison to effect the removal of the closure assembly.

With the above and other objects in view that will hereinafter appear, the nature of the invention will be more clearly understood by reference to the following detailed description, the appended claims and the several views illustrated in the accompanying drawings:

In the drawings:

FIG. 1 is a fragmentary top perspective view of a container having a closure assembly of this invention mounted thereon.

FIG. 2 is an enlarged fragmentary vertical sectional view taken along the line 2—2 of FIG. 1 and shows the specific constructions details of the closure assembly.

FIG. 3 is a transverse horizontal sectional view taken along the line 3—3 of FIG. 2 and shows more specifically the details of the interlockable relationship between the overcap and the closure member.

FIG. 4 is a horizontal sectional view similar to FIG. 3 and shows the overcap shifted relative to the closure member so as to interlock the two for rotation in unison.

FIG. 5 is an exploded perspective view of the two components of the closure assembly.

FIG. 6 is an exploded perspective view similar to FIG. 5 but showing a modified form of construction.

FIG. 7 is a horizontal sectional view similar to FIG. 3 taken through the modified closure assembly of FIG. 6.

Referring now to the drawings in detail, it will be seen that there is illustrated in FIG. 1 a container, generally identified by the numeral 10, having mounted thereon the closure assembly which is the subject of this invention, the closure assembly being generally identified by the numeral 11. As is best illustrated in FIG. 2, the container 10 has a neck finish 12 including radially outwardly projecting ribs 13 which may be in the form of screw threads or lugs with which the closure assembly 11 is engaged to normally effect closure of the container 10 and wherein removal of the closure assembly 11 can be effected only by rotational movement.

Referring now to FIG. 5 in particular, it will be seen that the closure assembly 11 includes a closure member, generally identified by the numeral 14, and an overcap, generally referred to by the numeral 15.

The closure member 14 is of a one-piece construction and includes a closure panel 16 having integrally connected thereto a depending skirt 17. The skirt is formed on the inner surface thereof with projecting rib means 18 which are illustrated in the form of screw threads adapted to engage with the screw threads 13 of the neck finish 12 so as to bring the closure panel into container closing engagement with the neck finish 12 in the manner shown in FIG. 2.

The overcap 15 is also of a one-piece construction and includes an end panel 20 having depending therefrom a sleeve 21. The sleeve 21 terminates at its lower end in an inwardly directed flange 22. As is clearly shown in FIGS. 2 and 3, the relative proportions of the skirt 17 and the sleeve 21 is such that the overcap 15 may be telescoped over the closure member 14 with the sleeve 21 spaced radially outwardly of the skirt 17. When the overcap 15 is telescoped over the closure member 14, the flange 22 underlies the skirt 17 and retains the overcap and the closure member in interlocked relation.

With particular reference to FIG. 2, it will be seen that the inner surface of the flange 22 is sloped as at 23 so as to facilitate the outward spreading of the flange 22 as is necessary to telescope the overcap 15 over the closure member 14.

The overcap 15 being freely rotatable relative to the closure member 14 telescoped therein, it will be readily apparent that unless the overcap is interlocked with the closure member, the closure member cannot be rotated so as to effect the removal thereof. Accordingly, interlockable means are provided on the overcap and the closure member. These interlockable means, as is best shown in FIGS. 3 and 5, include a plurality of axial ribs and grooves 24 formed on the inner surface of the skirt 21. The ribs and grooves 24 are of a limited circumferential extent. At this time it is also pointed out that the skirt 21 has formed therein a window 25 in diametrically opposite relation to the ribs and grooves 24. The purpose of the window 25 will be described hereinafter.

In the embodiment of the invention illustrated in FIGS. 1 through 5, the entire outer surface of the skirt 17 is provided with radially projecting and circumferentially spaced ribs and grooves 26 which are complementary to the ribs and grooves 24. It will thus be apparent that when the portion of the skirt 21 carrying the ribs and grooves 24 is shifted radialy inwardly from its normal centered position of FIG. 3, to the position shown in FIG. 4, the interlockable means formed by the ribs and grooves 24 in cooperation with the ribs and grooves 26 will be engaged and a rotational force applied to the overcap 15 will be transmitted to the closure member 14 to effect the rotation of the closure member 14 relative to the container 10 and the removal of the closure assembly.

At this time it is pointed out that by placing the window 25 in diametrical alignment with the ribs and grooves 25, the interlockable means between the closure member and the overcap may automatically be engaged by gripping the closure assembly in a manner wherein one finger engages the skirt 17 through the window 25 and the other finger engages the sleeve 21 in diametrically opposite relation thereto. This is clearly shown by the radial arrows in FIG. 4. Thus, with the embodiment of FIGS. 1 through 5, it is merely necessary to grip the closure assembly in the manner indicated by the arrows in FIG. 4 and then to apply the necessary rotational force to the closure assembly later to effect the turning thereof as a unit relative to the container 10 so as to remove the closure assembly. It will be readily apparent that the instructions for such a closure assembly are very simple and that the closure assembly may be readily manipulated. The actual force required to remove the closure assembly 11 is no greater than that required to remove the closure member 14 alone. At the same time, the closure assembly 11 is of a minimum complexity. It is formed from two readily formable members and the members may be suitably formed of plastic materials which need not be readily deformable thereby providing a wide choice of available plastic materials, including thermoplastic materials.

It will be readily apparent that the closure assembly 11 requires no specific orientation of the overcap 15 with respect to the closure member 14 in order to facilitate the interlocking therebetween. All that is required is an understanding as to how to grip the components of the closure assembly in order to facilitate the interlocking of the sleeve 21 with the skirt 17. However, there may be instances where one wishes to provide further safeguards. Accordingly, there is provided the closure assembly of FIGS. 6 and 7, which closure assembly is generally identified by the numeral 31.

The closure assembly 31 is of a construction very similar to that of the closure assembly 11 and includes a closure member 34 and an overlap 35.

The closure member 34 is of a construction substantially identical to that of the closure member 14 and includes a closure panel 36 and an integrally connected depending skirt 37. The skirt 37 is internally provided with threads (not shown) similar to the threads 18.

The closure assembly 31 differs from the closure assembly 11 primarily in the interlockable means with the external surface of the skirt 37 being provided with ribs and grooves 46 of only a limited circumferential extent. The skirt 37 is also provided with an aligning mark 47 disposed diametrically opposite from the ribs and grooves 46.

Referring now to the overcap 35, it will be seen that it is of an identical construction with that of the overcap 15 except that the exterior surface of the sleeve 21 thereof is provided with an alignment mark 48 immediately below the window 25. Accordingly, the overcap 35 will not be identified further, and the same reference numerals applied to the overcap 15 will be applied to like components of the overcap 35.

The overcap 35 is telescoped over the closure member 34 and the closure assembly 31 is applied to the container 10. When it is desired to remove the closure assembly 31, it is first necessary to rotate the overcap 35 relative to the closure member 34 until the alignment marks 47 and 48 are substantially in registration. This is diagrammatically illustrated in FIG. 7. At this time the ribs and grooves 24 of the overcap are aligned with the ribs and grooves 46 of the closure member 34. Then by gripping the closure assembly 31 in manner described with respect to the closure assembly 11 with particular reference to FIG. 4, it will be seen that the sleeve 21 will be interlocked with the skirt 37 and the closure member 34 and the overcap 35 may be rotated as a unit to remove the closure assembly 31 from the container 10.

It will be readily apparent that while the construction of the closure assembly 31 remains simple, and the force required to remove the same is still limited, it will be apparent that the operation thereof is more complex so as to require a more intelligent person for the operation thereof, thereby making it much more difficult for a small child to operate the same.

Although only two embodiments of the invention have been specifically illustrated and described herein, it is to be understood that minor variations may be made in the closure assembly, particularly in the interlockable means thereof, without departing from the spirit and scope of the invention, as defined by the appended claims.

I claim:

1. A child-resistant closure assembly for a container of the type including a neck finish adapted to have rotationally removed therefrom a closure, said closure assembly comprising a closure member and an overcap telescoped over said closure member, said closure member including a closure panel and a skirt connected to said closure panel, means on the interior of said skirt for interlocking with a container neck finish, said overcap including an end panel overlying said closure panel, a sleeve connected to said end panel and telescoped over said skirt, and a radially inwardly directed flange on said skirt remote from said end panel, said end panel and said flange having retained therebetween said closure member restraining said closure member against separation from said overcap, said sleeve having an internal diameter in excess of an external diameter of said skirt to normally provide a spacing between said skirt and said sleeve facilitating relative rotation between said skirt and said sleeve, interlockable means carried by said sleeve and said skirt for rotationally interconnecting said sleeve and said skirt upon radial displacement of said sleeve relative to said skirt, said sleeve having a finger receiving window therethrough diametrically opposite to said interlockable means for facilitating the manual radial displacement of said sleeve into rotational interlocking engagement with said skirt in response to the manual gripping of said skirt and said sleeve at diametrically opposite points.

2. The closure assembly of claim 1 wherein said sleeve is formed of rigid deformation resistant material.

3. The closure assembly of claim 1 wherein said interlockable means include cooperable ribs and grooves on said sleeve and said skirt.

4. The closure assembly of claim 3 wherein said ribs and grooves on said sleeve are of a limited circumferential extent and disposed diametrically opposite to said window.

5. The closure assembly of claim 4 wherein ribs and grooves of said skirt are continuous about said skirt wherein alignment of said interlockable means is automatic.

6. The closure assembly of claim 4 wherein said ribs and grooves in said skirt are of a limited circumferential extent wherein specific orientation of said sleeve and said skirt is required for engagement of said interlockable means, and there are cooperable alignment means on said closure member and said overcap for aligning said interlockable means.

7. The closure assembly of claim 6 wherein said alignment means includes an aligning mark on said skirt viewable through said window when said interlockable means are aligned.

8. The closure assembly of claim 6 wherein said alignment means includes an aligning mark on said skirt viewable through said window and an aligning mark on said sleeve adjacent said window.

* * * * *